US005741117A

United States Patent [19]

Clevenger et al.

[11] Patent Number: 5,741,117

[45] Date of Patent: Apr. 21, 1998

[54] METHOD FOR COOLING A GAS TURBINE STATOR VANE

[75] Inventors: Douglas H. Clevenger; Mary Curley Matyas, both of Palm Beach Gardens, Fla.

[73] Assignee: United Technologies Corporation, Hartford, Conn.

[21] Appl. No.: 735,362

[22] Filed: Oct. 22, 1996

[51] Int. Cl.[6] ..... F01D 5/18

[52] U.S. Cl. ..... 413/115; 416/97 R

[58] Field of Search ..... 416/97 R, 97 A; 415/115; 60/39.75

[56] References Cited

U.S. PATENT DOCUMENTS

| | | | |
|---|---|---|---|
| 3,533,712 | 10/1970 | Kercher | 416/92 |
| 3,807,892 | 4/1974 | Frei et al. | 415/116 |
| 3,846,041 | 11/1974 | Albani | 416/97 |
| 4,236,870 | 12/1980 | Hucul, Jr. et al. | 416/97 R |
| 4,257,737 | 3/1981 | Andress et al. | 416/97 |
| 4,753,575 | 6/1988 | Levengood et al. | 416/97 R |
| 4,767,268 | 8/1988 | Auxier et al. | 416/97 R |
| 4,770,608 | 9/1988 | Anderson et al. | 416/97 R |
| 5,117,626 | 6/1992 | North et al. | 60/39.75 |
| 5,387,086 | 2/1995 | Frey et al. | 416/97 R |
| 5,498,126 | 3/1996 | Pighetti et al. | 415/115 |

OTHER PUBLICATIONS

T. Auxier, G. A. Bonner, D. Clevenger, S. N. Finger, AIAA-85-1221 "Military Engine Durability Improvements through Innovative Advancements in Turbine Design and Materials", AIAA/SAE/ASME/ASEE 21st Joint Propulsion Conference, Jul. 8-10, 1985, Monterey, California, copyright 1985 by the American Institute of Aeronautics and Astronautics, Inc.

*Primary Examiner*—Edward K. Look
*Assistant Examiner*—Richard S. Woo
*Attorney, Agent, or Firm*—Richard D. Getz

[57] ABSTRACT

A method for cooling a stator vane is provided, comprising the steps of: (a) providing a hollow stator vane having a high pressure and a standard pressure chamber disposed within the hollow stator vane, adjacent the leading edge of the airfoil, and a supply chamber, disposed within the hollow stator vane, aft of the high and standard pressure chambers, and forward of the trailing edge; the stator vane further includes first and second inlet apertures, and first and second exit apertures; the first inlet apertures extend between the high pressure chamber and the supply chamber, and the second inlet apertures extend between the standard pressure chamber and the supply chamber; the first exit apertures extend between the high pressure chamber and the exterior of the stator vane, and the second exit apertures extend between the standard pressure chamber and the exterior of the stator vane; (b) determining the magnitudes of the gas flow pressure gradient facing the stator vane, and the position of the gradient relative to the stator vane; (c) manipulating the inlet apertures or both the inlet and exit apertures such that the pressure in the high chamber is greater than the pressure in the standard pressure chamber for a given pressure in the supply chamber; and (d) positioning the high pressure chamber along the leading edge to oppose an external high pressure region acting on the stator vane.

15 Claims, 3 Drawing Sheets

METHOD FOR COOLING A GAS TURBINE STATOR VANE

The invention was made under a U.S. Government contract and the Government has rights herein.

BACKGROUND OF THE INVENTION

1. Technical Field

This invention relates to gas turbine engine stator vanes in general, and to methods for cooling stator vanes in particular.

2. Background Information

Stator vane assemblies are used to direct fluid flow entering or exiting rotor assemblies with a gas turbine engine. Each stator vane assembly typically includes a plurality of stator vanes extending radially between an inner and an outer platform. The temperature of core gas flow passing the stator vanes typically requires cooling within the stator vanes. Cooling schemes, particularly film cooling, permit a greater variety of vane materials and increase vane life.

"Cooling air" at a lower temperature and higher pressure than the core gas is typically introduced into an internal cavity of a vane, where it absorbs thermal energy. The cooling air subsequently exits the vane via apertures in the vane walls, transporting the thermal energy away from the vane. In instances where film cooling is used, the pressure difference across the vane walls and the flow rate at which the cooling air exits the vane is critical, particularly along the leading edge where film cooling initiates. Historically, internal vane structures (for vanes utilizing film cooling) have been defined by first establishing the minimum acceptable pressure difference at any point along the leading edge (internal versus external pressure), and subsequently manipulating the internal vane structure along the entire leading edge such that the minimal allowable pressure difference is present along the entire leading edge. The problem with this approach is that core gas flow pressure gradients along the leading edge of a vane may have one or more small regions (i.e., "spikes") at a pressure considerably higher than the rest of the gradient along the leading edge. This is particularly true for those stator vanes disposed aft of rotor assemblies, where relative motion between rotor blades and stator vanes can significantly influence the core gas flow profile. Increasing the minimum allowable pressure to accommodate the spikes consumes an excessive amount of cooling air. A person of skill in the art will recognize that it is a distinct advantage to minimize the amount air required for cooling purposes.

What is needed, therefore, is a method for accommodating high pressure spikes in the core gas flow adjacent the leading edge of a stator vane.

DISCLOSURE OF THE INVENTION

It is, therefore, an object of the present invention to provide a method for cooling a stator vane that can accommodate high pressure spikes in the core gas flow outside the stator vane's leading edge.

It is another object of the present invention to provide a method for cooling a stator vane that extends the useful life of the vane.

It is another object of the present invention to provide a method for cooling a stator vane that improves film cooling about the exterior of the vane.

According to the present invention, a method for cooling a stator vane is provided, comprising the steps of:

(a) Providing a hollow stator vane having a high pressure and a standard pressure chamber disposed within the hollow stator vane, adjacent the leading edge of the stator vane, and a supply chamber, disposed within the hollow stator vane, aft of the high and standard pressure chambers, and forward of the trailing edge. The stator vane further includes first and second inlet apertures, and first and second exit apertures. The first inlet apertures extend between the high pressure chamber and the supply chamber, and the second inlet apertures extend between the standard pressure chamber and the supply chamber. The first exit apertures extend between the high pressure chamber and the exterior of the stator vane, and the second exit apertures extend between the standard pressure chamber and the exterior of the stator vane.

(b) Determining the magnitudes of the gas flow pressure gradient facing the stator vane, and the position of the gradient relative to the stator vane.

(c) Manipulating the inlet apertures or both the inlet and exit apertures such that the pressure in the high chamber is greater than the pressure in the standard pressure chamber for a given pressure in the supply chamber.

(d) Positioning the high pressure chamber along the leading edge to oppose an external high pressure region acting on the airfoil.

An advantage of the present invention is that a method is provided able to accommodate high pressure spikes in core gas flow adjacent the vane's leading edge.

Another advantage of the present invention is that a method is provided that minimizes the use of cooling air. The present invention allows the leading edge cooling to be tailored to the pressure gradient facing the stator vane. As a result, higher pressure cooling air can be provided along the leading edge to oppose external high pressure regions of hot gas.

Another advantage of the present invention is that the useful life of a stator vane can be increased. The present invention provides high internal pressure along the leading edge opposite external hot gas high pressure regions. As a result, undesirable inflow of hot gas and consequent damage is avoided, thereby increasing the vane's useful life.

Another advantage of the present invention is that it provides a method for more closely controlling the difference in pressure across the leading edge which, in turn, enables optimization of film cooling about the exterior of the vane.

These and other objects, features and advantages of the present invention will become apparent in light of the detailed description of the best mode embodiment thereof, as illustrated in the accompanying drawings.

BEST MODE FOR CARRYING OUT THE INVENTION

Figure 1:
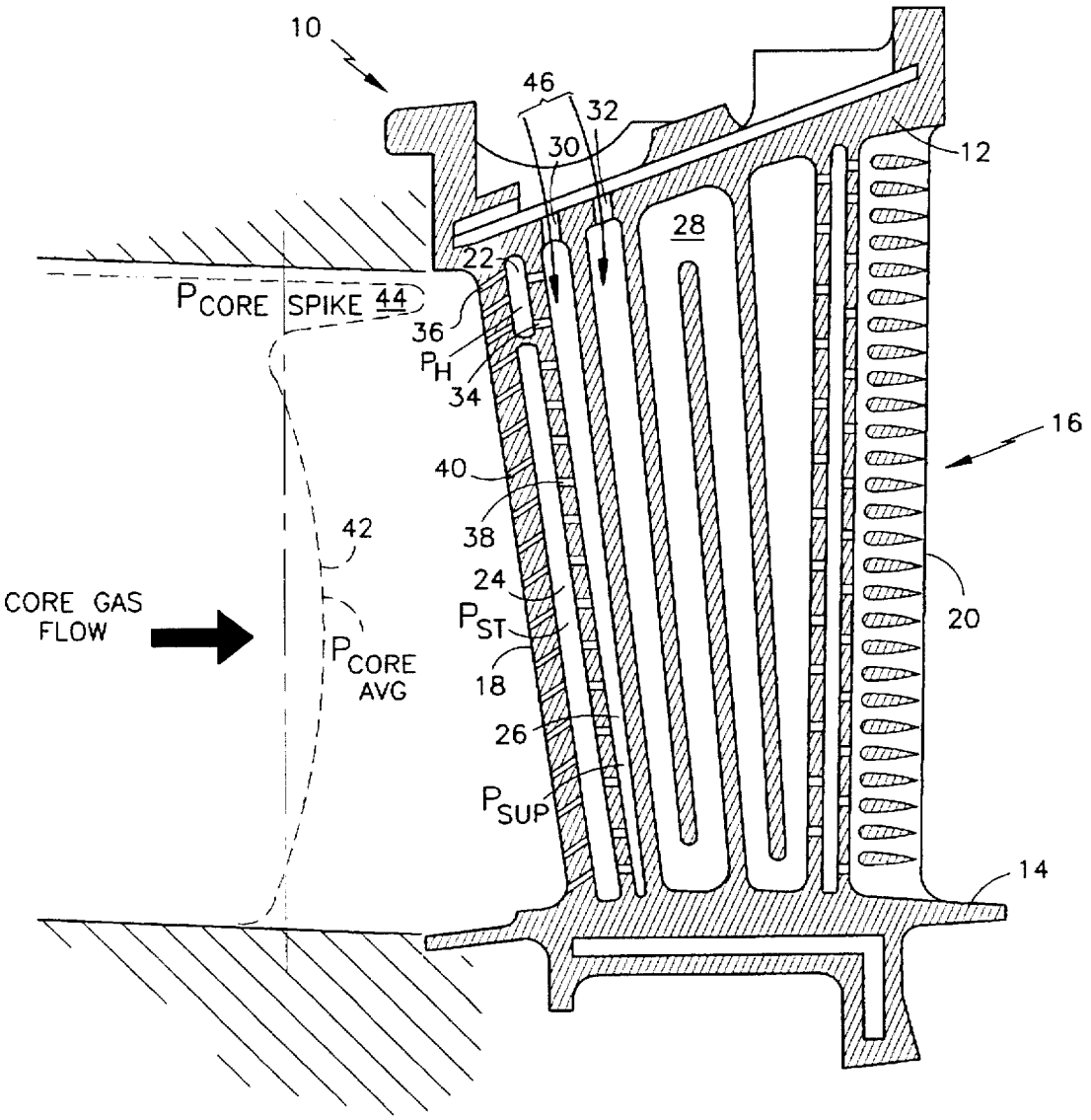
FIG. 1 is a diagrammatic view of a sectioned stator vane shown with a pressure gradient facing the leading edge of the vane. The gradient includes a single spike adjacent the outer platform of the vane.
Figure 2:
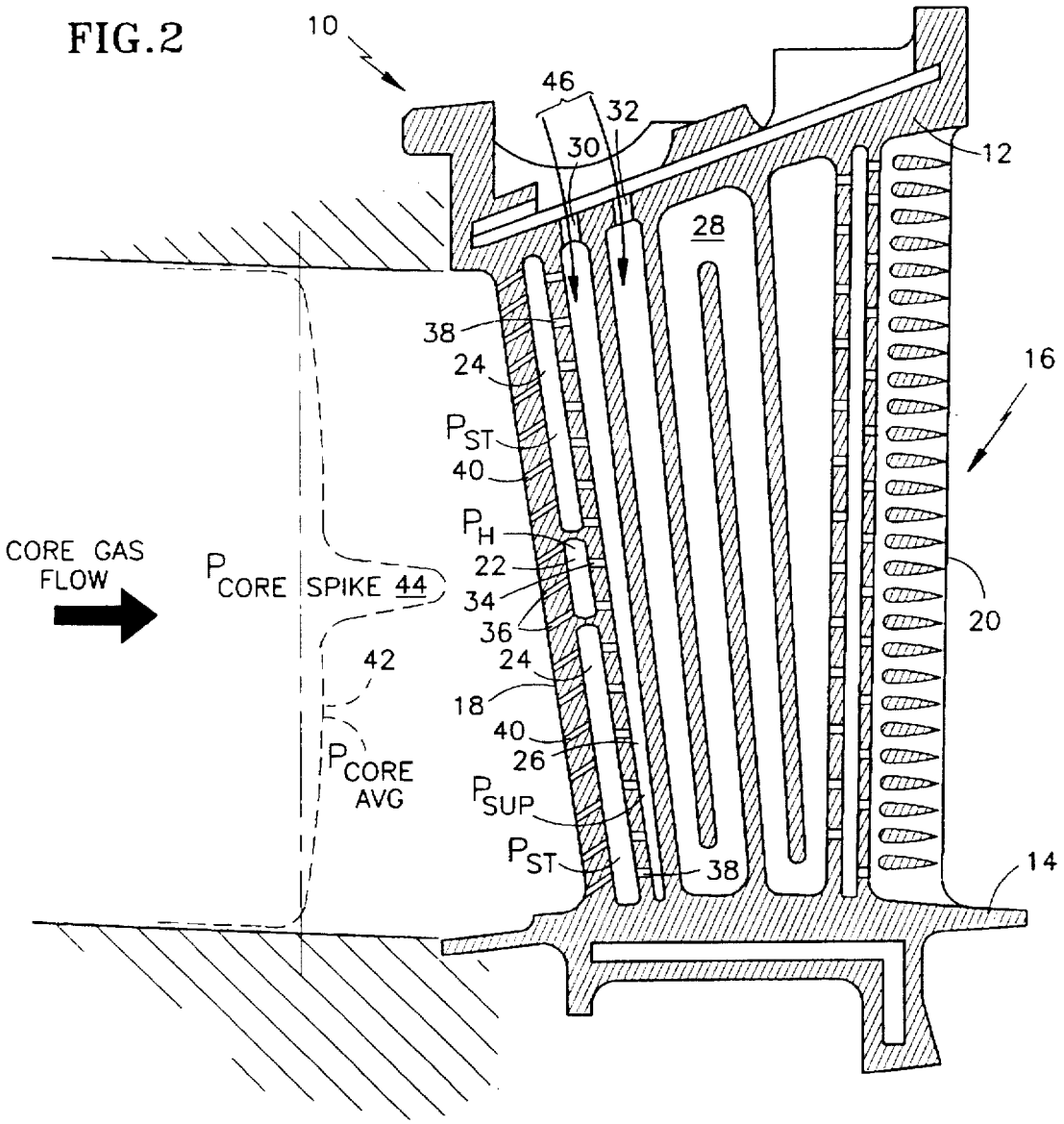
FIG. 2 is a diagrammatic view of a sectioned stator vane shown with a pressure gradient facing the leading edge of the vane. The gradient includes a single spike adjacent the radial midpoint of the vane.
Figure 3:
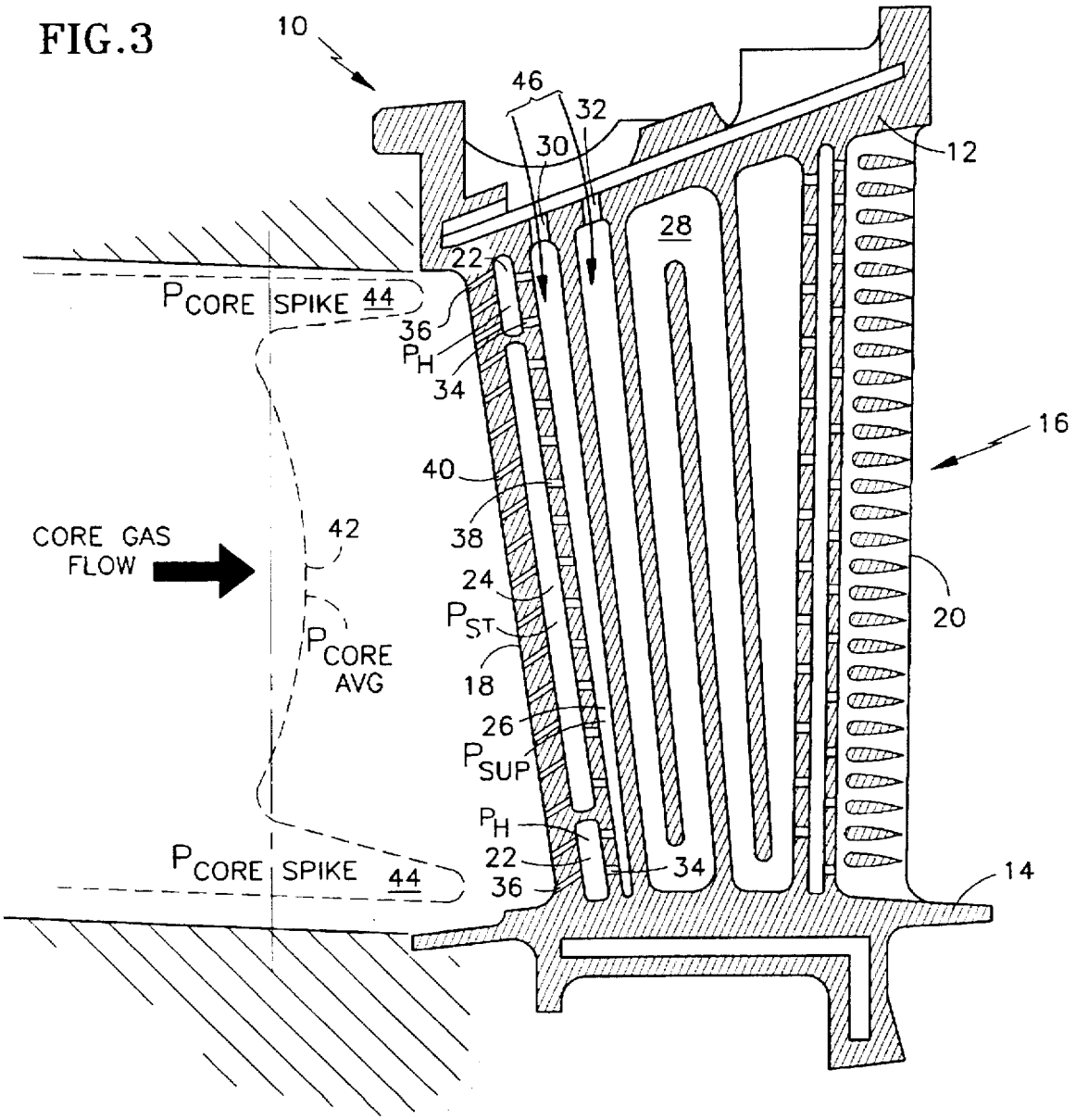
FIG. 3 is a diagrammatic view of a sectioned stator vane shown with a pressure gradient facing the leading edge of the vane. The gradient includes a pair of spikes.

Referring to FIGS. 1–3, a turbine stator vane 10 includes an outer platform 12, an inner platform 14 and an airfoil 16 extending therebetween. The hollow airfoil 16 includes a forward, or "leading", edge 18, and an aft, or "trailing", edge 20. The hollow airfoil 16 further includes a high pressure chamber 22, a standard pressure chamber 24, and a supply chamber 26. The high 22 and standard pressure 24 chambers are disposed within the hollow airfoil 16, adjacent the leading edge 18. The supply chamber 26 is disposed aft of the high pressure 22 and standard pressure 24 chambers, and forward of the trailing edge 20. The embodiments shown in FIGS. 1–3, further include a serpentine chamber 28 disposed between the supply chamber 26 and the trailing edge 20. A first passage 30 extends from the supply chamber 26, through the outer platform 12, to the exterior of the outer platform 12. Likewise, a second passage 32 extends from the serpentine chamber 28, through the outer platform 12, to the exterior of the outer platform 12.

A plurality of first inlet apertures 34 extend between the supply chamber 26 and the high pressure chamber 22 and a plurality of first exit apertures 36 extend between the high pressure chamber 22 and the exterior of the airfoil 16. Similarly, a plurality of second inlet apertures 38 extend between the supply chamber 26 and the standard pressure chamber 24 and a plurality of second exit apertures 40 extend between the standard pressure chamber 24 and the exterior of the airfoil 16.

In the operation of a gas turbine engine, hot core gas flow acts on the airfoil 16 of a stator vane 10 in an unsymmetric manner. This is particularly true for stator vanes 10 disposed aft of rotor assemblies (not shown). The unsymmetric core gas flow may be illustrated graphically as a pressure gradient 42 depicting pressure within the core gas flow along the leading edge. FIG. 1 illustrates an example of a pressure gradient 42 which includes a single spike 44 (i.e., a high pressure region) positioned adjacent the outer platform 12 of the vane 10. FIG. 2 illustrates an example of a pressure gradient 42 having a single spike 44 positioned adjacent the radial midpoint of the vane 10. FIG. 3 illustrates an example of a pressure gradient 42 which includes a pair of spikes 44. A person of skill in the art will recognize that a stator vane 10 may be exposed to an infinite number of different pressure gradients, depending on the flow conditions upstream of the stator vane 10. Cooling air 46, at a temperature lower and a pressure higher than the core gas flow, is directed into the stator vane 10 through the passages 30,32 within the outer platform 12.

The pressure gradient 42 opposite the stator vane 10 is evaluated for magnitude and position relative to the stator vane 10. Once the magnitude of the pressure gradient 42 is known, the inlet 34 and exit 36 apertures of the high pressure chamber 22 are manipulated to produce a pressure ($P_H$) in the high pressure chamber 22 that will exceed the core gas pressure outside the vane ($P_{CORE\ SPIKE}$), adjacent the high pressure chamber 22 for a given supply chamber 26 pressure ($P_{SUP}$). Likewise, the inlet 38 and exit 40 apertures of the standard pressure chamber 24 are manipulated to produce a pressure ($P_{ST}$) in the standard pressure chamber 24 that will exceed the core gas pressure outside the vane ($P_{CORE\ AVG}$), adjacent the standard pressure chamber 24 for a given supply chamber 26 pressure ($P_{SUP}$). In relative terms, the pressure in the supply chamber 26 is greater than that in the high pressure chamber 22, which is greater than that in the standard chamber 24 ($P_{SUP}>P_H>P_{ST}$).

In most cases, the difference in pressure between the high pressure 22 and the standard pressure 24 chambers can be created by having the diameters of the first inlet apertures 34 exceed those of the second inlet 38 apertures; i.e., a smaller pressure drop between the supply 26 and high pressure 22 chambers than exists between the supply 26 and standard pressure 24 chambers. In other cases, where manufacturing constraints limit the diameter of the apertures, the number of first 34 and second inlet 38 apertures can be manipulated for similar effect in place of, or in addition to, varying the diameters. The first 36 and second 40 exit apertures can also be manipulated in like manner to effect the pressures in the high 22 and standard 24 pressure chambers. In fact, in the preferred embodiment of the present invention the flow rate exiting the first exit apertures 36 equals that exiting the second exit apertures 40 on a per aperture basis. Flow rate uniformity across the leading edge 18 is accomplished by making the diameters of the first exit apertures 36 less than those of the second exit apertures 40.

Once the position of the pressure gradient 42 relative to the stator vane 10 is known, the high pressure chamber 22 is positioned inside the leading edge 18 of the stator vane 10 opposite the pressure spikes 44. In FIG. 1, for example, the stator vane 10 includes a single high pressure chamber 22 positioned opposite the pressure spike 44 adjacent the outer platform 12. FIG. 2 shows a high pressure chamber 22 positioned opposite the pressure spike 44 adjacent the radial midpoint of the vane 10. FIG. 3 shows a high pressure chamber 22 positioned opposite each pressure spike 44. In all three examples, one or more standard pressure chambers 24 extends along the remainder of the leading edge 18.

Although this invention has been shown and described with respect to the detailed embodiments thereof, it will be understood by those skilled in the art that various changes in form and detail thereof may be made without departing from the spirit and the scope of the invention.

We claim:

1. A method for cooling a stator vane, comprising the steps of:

(a) providing a hollow stator vane having:

a leading edge;

a trailing edge;

a high pressure chamber, disposed within said hollow airfoil, adjacent said leading edge;

a standard pressure chamber, disposed within said hollow stator vane, adjacent said leading edge;

a supply chamber, disposed within said hollow stator vane, aft of said high and standard pressure chambers, and forward of said trailing edge;

a plurality of first inlet apertures, extending between said high pressure chamber and said supply chamber, said first inlet apertures having a first cross-sectional area;

a plurality of second inlet apertures, extending between said standard pressure chamber and said supply chamber, said second inlet apertures having a second cross-sectional area;

a plurality of first exit apertures, extending from said high pressure chamber to outside of said stator vane, each having a third cross-sectional area; and a plurality of second exit apertures, extending from said standard pressure chamber to outside of said stator vane, each having a fourth cross-sectional area;

(b) determining a gas flow pressure gradient facing said stator vane, including said gradient's magnitude and position relative to said stator vane;

(c) manipulating said first and second inlet and exit apertures such that pressure ($P_H$) in said high chamber is greater than pressure ($P_{ST}$) in said standard pressure chamber for a given pressure in said supply chamber ($P_{SUP}$);

(d) positioning said high pressure chamber along said leading edge to oppose a pressure spike in said gas flow pressure gradient.

2. A method according to claim 1, wherein said stator vane comprises a pair of standard pressure chambers, and said high pressure chamber is positioned between said standard pressure chambers.

3. A method according to claim 1, wherein said stator vane includes a plurality of high pressure chambers.

4. A method according to claim 3, wherein said stator vane includes a plurality of standard pressure chambers, and at least one of said standard pressure chambers is positioned between said high pressure chambers.

5. A method according to claim 3, wherein said cross-sectional area of said first inlet apertures is greater than that of said second inlet apertures.

6. A method according to claim 5, wherein gas flow rate exiting each said first exit aperture substantially equals gas flow rate exiting each said second exit aperture, for a given pressure in said supply chamber.

7. A method according to claim 6, wherein said cross-sectional area of said first exit apertures is less than that of said second inlet apertures.

8. A method according to claim 1, wherein said cross-sectional area of said first inlet apertures is greater than that of said second inlet apertures.

9. A method according to claim 8, wherein gas flow rate exiting each said first exit aperture substantially equals gas flow rate exiting each said second exit aperture, for a given pressure in said supply chamber.

10. A method according to claim 9, wherein said cross-sectional area of said first exit apertures is less than that of said second inlet apertures.

11. A stator vane, comprising:

a leading edge;

a trailing edge;

a high pressure chamber, disposed within said hollow airfoil, adjacent said leading edge;

a standard pressure chamber, disposed within said hollow stator vane, adjacent said leading edge;

a supply chamber, disposed within said hollow stator vane, aft of said high and standard pressure chambers, and forward of said trailing edge;

a plurality of first inlet apertures, extending between said high pressure chamber and said supply chamber, said first inlet apertures having a first cross-sectional area;

a plurality of second inlet apertures, extending between said standard pressure chamber and said supply chamber, said second inlet apertures having a second cross-sectional area;

a plurality of first exit apertures, extending from said high pressure chamber to outside of said stator vane, each having a third cross-sectional area; and a plurality of second exit apertures, extending from said standard pressure chamber to outside of said stator vane, each having a fourth cross-sectional area;

wherein said cross-sectional areas of said first and second inlet apertures and said first and second exit apertures are such that gas pressure within said high pressure chamber is greater than gas pressure within said standard pressure chamber for a given gas pressure in said supply chamber.

12. A stator vane according to claim 11, wherein said stator vane comprises a pair of standard pressure chambers, and said high pressure chamber is positioned between said standard pressure chambers.

13. A stator vane according to claim 12, further comprising a plurality of high pressure chambers.

14. A stator vane according to claim 13, wherein said cross-sectional area of said first inlet apertures is greater than that of said second inlet apertures.

15. A stator vane according to claim 14, wherein said cross-sectional area of said first exit apertures is less than that of said second inlet apertures.

* * * * *